US009295293B2

(12) United States Patent
Rosenhaus

(10) Patent No.: US 9,295,293 B2
(45) Date of Patent: Mar. 29, 2016

(54) POCKET SYSTEM FOR CLOTHING

(71) Applicant: Cathy Rosenhaus, West Bloomfield, MI (US)

(72) Inventor: Cathy Rosenhaus, West Bloomfield, MI (US)

( * ) Notice: Subject to any disclaimer, the term of this patent is extended or adjusted under 35 U.S.C. 154(b) by 0 days.

(21) Appl. No.: 14/808,834

(22) Filed: Jul. 24, 2015

(65) Prior Publication Data

US 2015/0327607 A1 Nov. 19, 2015

Related U.S. Application Data

(63) Continuation of application No. 14/491,634, filed on Sep. 19, 2014.

(60) Provisional application No. 61/924,390, filed on Jan. 7, 2014.

(51) Int. Cl.

| | |
|---|---|
| ***A41D 27/20*** | (2006.01) |
| ***A41D 1/08*** | (2006.01) |
| ***A41D 1/14*** | (2006.01) |
| ***A41D 1/22*** | (2006.01) |

(52) U.S. Cl.

CPC ..... *A41D 27/207* (2013.01); *A41D 1/08* (2013.01); *A41D 1/14* (2013.01); *A41D 1/22* (2013.01); *A41D 27/20* (2013.01); *A41D 27/204* (2013.01); *A41D 2600/10* (2013.01)

(58) Field of Classification Search

CPC ..... A41D 1/06; A41D 1/08; A41D 1/005; A41D 27/20; A41D 27/24; A41D 13/0012; A41D 13/0007; A41D 13/0568; A41F 9/00; A41F 19/00; A45F 5/02

USPC ..... 2/220, 227, 221, 231, 236, 237, 247, 2/255, 248, 326, 333; 224/223, 660, 663, 224/676–680, 682, 230, 254

See application file for complete search history.

(56) References Cited

U.S. PATENT DOCUMENTS

| | | | | |
|---|---|---|---|---|
| 514,576 | A | 2/1894 | Walther et al. | |
| 3,624,686 | A * | 11/1971 | Beals | G09B 19/0023 2/247 |
| D281,636 | S | 12/1985 | Cressy-Renoma | |
| 4,848,624 | A * | 7/1989 | Clem | A45C 1/04 224/222 |
| 4,910,802 | A * | 3/1990 | Malloy | A41D 13/0015 2/227 |
| 5,445,303 | A * | 8/1995 | Cawile, Jr. | F41C 33/00 224/222 |
| 5,771,496 | A | 6/1998 | Wood | |
| 6,149,042 | A * | 11/2000 | Rassias | A45F 5/00 224/243 |
| 7,766,203 | B2 * | 8/2010 | Marinaj | A45F 5/00 224/232 |
| 8,418,268 | B2 | 4/2013 | Waldman et al. | |
| 8,474,066 | B2 | 7/2013 | Kato | |
| 2005/0017034 | A1 * | 1/2005 | Ausanio | A41D 13/0012 224/230 |
| 2007/0136930 | A1 | 6/2007 | Dipietro | |
| 2008/0185412 | A1 * | 8/2008 | Hollins | A45F 5/02 224/661 |

(Continued)

*Primary Examiner* — Andrew W Collins

(74) *Attorney, Agent, or Firm* — Akerman LLP

(57) ABSTRACT

According to one embodiment, a pocket system includes an item of clothing having a waistband portion that is connected to first and second leg portions by one or more waistband seams arranged around at least a portion of the waistband portion. The first leg portion includes one or more first leg seams, and the second leg portion includes one or more second leg seams. The system further includes one or more waistband cables coupled to a portion of the one or more waistband seams, and one or more leg cables coupled to a portion of the one or more first leg seams and further coupled to the one or more waistband cables. The system also include a first pocket frame coupled to the one or more leg cables, and a first pocket coupled to the first pocket frame.

20 Claims, 5 Drawing Sheets

(56) References Cited

U.S. PATENT DOCUMENTS

2012/0117713 A1* 5/2012 Hoffner ..... A41D 27/20
2/227

2012/0158041 A1* 6/2012 Craig ..... A41D 1/06
606/203

2013/0025026 A1* 1/2013 Smith ..... A42B 1/225
2/209.3

* cited by examiner

POCKET SYSTEM FOR CLOTHING

CROSS-REFERENCE TO RELATED APPLICATION

This application is a continuation of U.S. patent application Ser. No. 14/491,634 entitled Pocket System for Clothing, and filed Sep. 19, 2014, which claims priority to U.S. Provisional Patent Application No. 61/924,390, filed Jan. 7, 2014, the entirety of both of which are incorporated herein.

TECHNICAL FIELD

This disclosure relates generally to the field of clothing and more specifically to a pocket system for clothing.

BACKGROUND

It may be difficult to utilize pockets on particular items of clothing, such as active-wear pants, because the weight of the pocket and the contents of the pocket may weigh down the item of clothing and the pocket, thus making carrying the item within the pocket uncomfortable to the user. Furthermore, the lightweight and/or stretchy nature of particular items of clothing, such as active-wear pants, may prohibit the use of pockets to carry items. As such, typical items of clothing may be deficient.

SUMMARY

According to one embodiment, a pocket system includes an item of clothing having a waistband portion, a first leg portion, and a second leg portion. The waistband portion is connected to the first and second leg portions by one or more waistband seams arranged around at least a portion of the waistband portion. The first leg portion includes one or more first leg seams arranged along at least a portion of a length of the first leg portion. The second leg portion includes one or more second leg seams arranged along at least a portion of a length of the second leg portion. The pocket assembly system further includes one or more waistband cables coupled to a portion of the one or more waistband seams, and one or more leg cables coupled to a portion of the one or more first leg seams and further coupled to the one or more waistband cables. The pocket assembly system also include a first pocket frame coupled to the one or more leg cables, and a first pocket coupled to the first pocket frame.

Certain embodiments of the disclosure may provide one or more technical advantages. For example, by coupling the pocket to a pocket frame (which is coupled to one or more leg cables and one or more waistband cables), the pocket may be capable of carrying the weight of one or more items in a manner that does not tug the item of clothing (such as active-wear pants) down from the weight. In particular embodiments, this may allow pockets to be added to particular types of clothing (such as active-wear pants, which may have flexibility and may be comfortable) for added functionality. Furthermore, it may enable the clothing to be used in additional activities where pockets are useful or necessary. For example, it may enable active-wear pants to be used in the workplace to carry equipment or tools, or to be used in activities other than exercise and the practice of yoga. Additionally, when one or more items are added to the pockets, the pockets may allow the weight of the items to be borne (or otherwise carried) by a user's legs and/or core, as opposed to a user's back and/or shoulders (which would bear the weight if the items were carried in a backpack or purse, or tool belt, as may be required when wearing conventional active wear pants).

Certain embodiments of the disclosure may include none, some, or all of the above technical advantages. One or more other technical advantages may be readily apparent to one skilled in the art from the figures, descriptions, and claims included herein.

BRIEF DESCRIPTION OF THE FIGURES

For a more complete understanding of the present disclosure and its features and advantages, reference is now made to the following description, taken in conjunction with the accompanying drawings, in which.

DETAILED DESCRIPTION

Figures 1, 2, 3, 4:
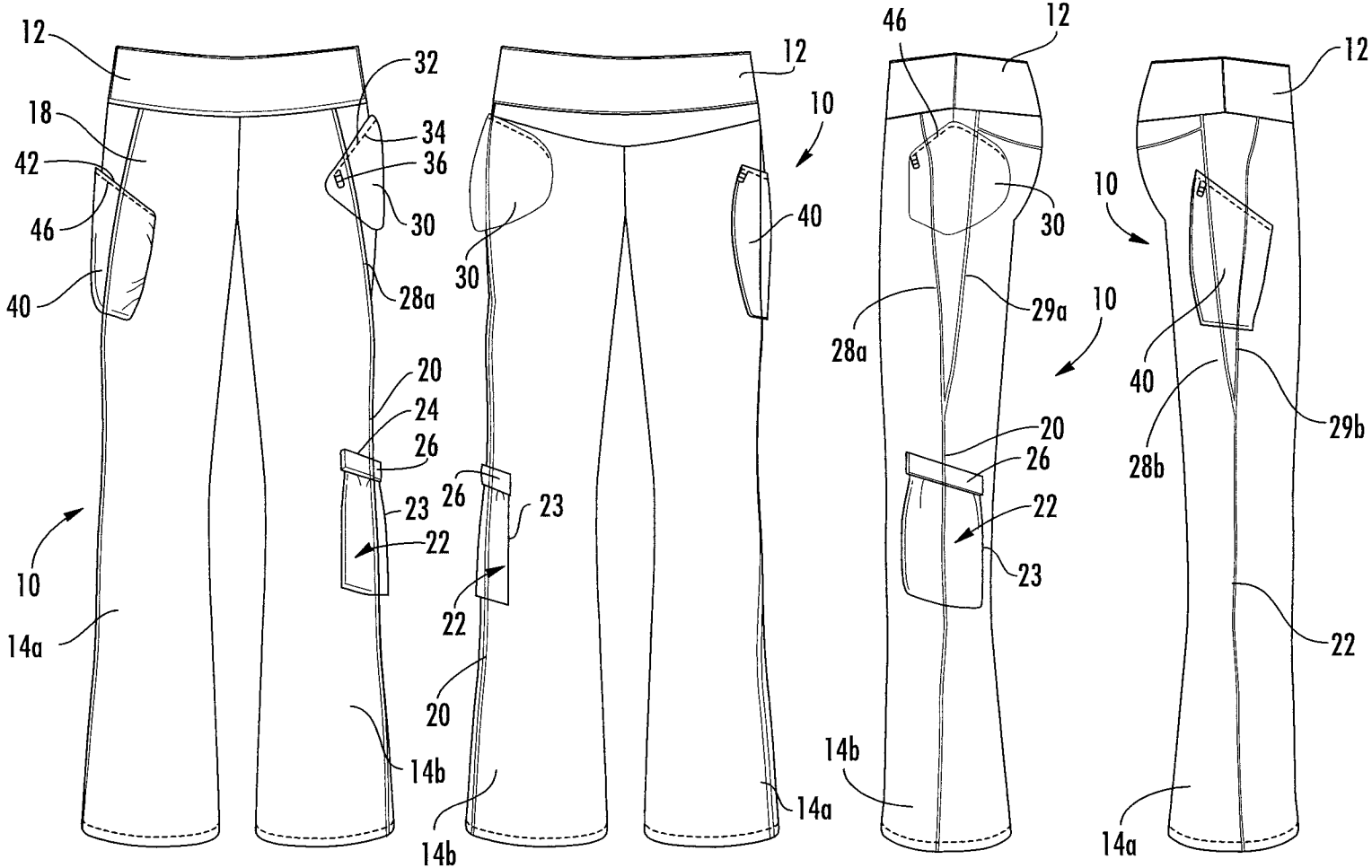
FIG. 1 illustrates a front view of an item of clothing having pockets that are added according to one example of the disclosure.
FIG. 2 illustrates a rear view of the clothing of FIG. 2.
FIG. 3 illustrates a first side view of the clothing of FIG. 2.
FIG. 4 illustrates a second side view of the clothing of FIG. 2.
Figures 5, 6, 7, 8:
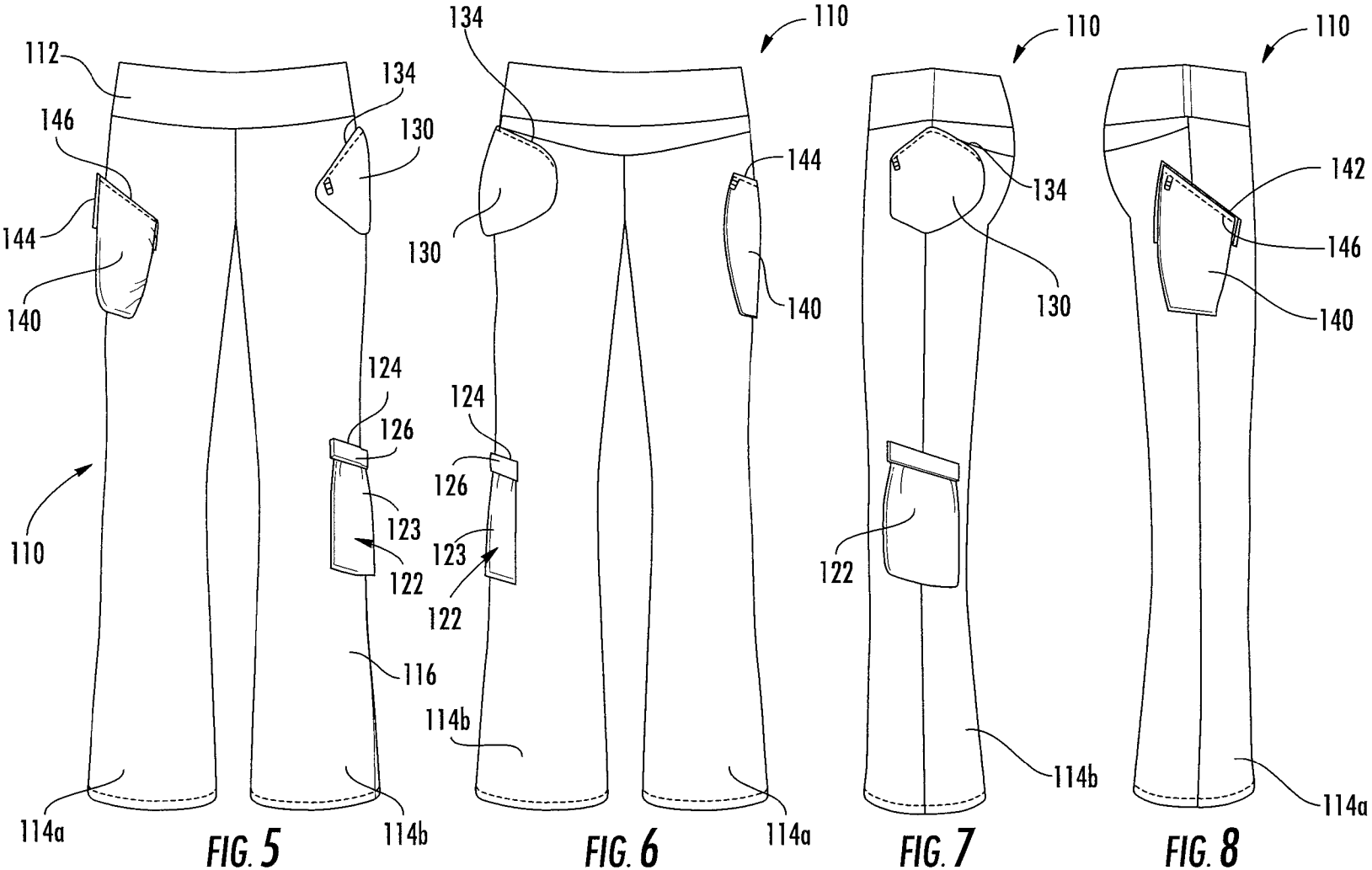
FIG. 5 illustrates a front view of an item of clothing having pockets that are added according to another example of the disclosure.
FIG. 6 illustrates a rear view of the clothing of FIG. 5.
FIG. 7 illustrates a first side view of the clothing of FIG. 5.
FIG. 8 illustrates a second side view of the clothing of FIG. 5.
Figure 9:
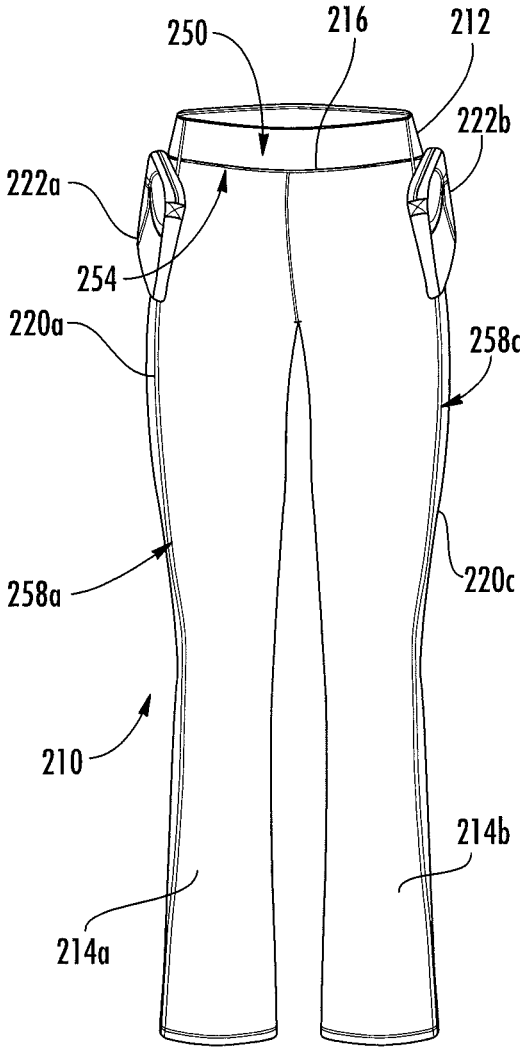
FIG. 9 illustrates a front view of an item of clothing having pockets that are added according to another example of the disclosure.
Figure 10:
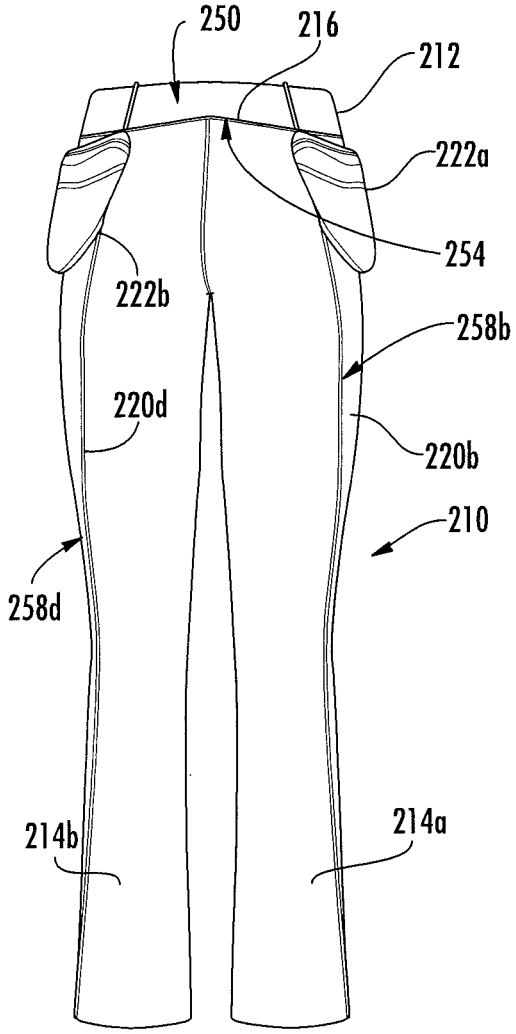
FIG. 10 illustrates a rear view of the clothing of FIG. 9.

Embodiments of the present disclosure are best understood by referring to FIGS. 1-13 of the drawings, like numerals being used for like and corresponding parts of the various drawings.

The present disclosure provides examples of clothing with pockets (and/or other additional structure) added to the clothing in a manner that may prevent the pockets from tugging when the user puts something within the pocket. FIGS. 1-4 illustrate a first example of an item of clothing with one or more pockets added to the clothing by positioning the pockets over major seams FIGS. 5-8 illustrate a second example of an item of clothing with one or more pockets added to the clothing by adding one or more pocket frames to the clothing in order to hang (or otherwise couple) pockets from the pocket frames. FIGS. 9-13 illustrate a third example of an item of clothing with one or more pockets added to the clothing by coupling a cabling system to the clothing, and also coupling one or more pocket frames to the cabling system in order to hang (or otherwise couple) pockets from the pocket frames. In particular embodiments, these example methods of adding pockets to clothing may provide additional support for pockets on the clothing.

FIGS. 1-4 illustrate a first example of an item of clothing with one or more pockets added to the clothing by positioning the pockets over major seams. As illustrated, the item of clothing 10 includes a pair of active-wear pants, such as exercise pants, spandex performance pants, or yoga-type pants. The active-wear pants may be made of a stretch fabric that has a compression quality that enhances the performance of the pockets added to the active-wear pants. Although clothing 10 is illustrated as active-wear pants, clothing 10 may be any other suitable type of clothing, such as any other type of pants, shorts, a skirt, or a dress. Clothing 10 includes a waistband portion 12 (which may be reinforced with a foundation fabric or elastic, such as a power mesh contained within the waistband portion 12) and leg portions 14 (such as first leg portion 14*a* and second leg portion 14*b*). Leg portions 14 may have at least one major seam 20. The major seam 20 is positioned on the outside seam or outside portion of the leg portion 14. The seam is sewed together by means of thread or other suitable fastening material. The seam is strong enough to hold and support the contents of a pocket. The seam 20 provides for increased stability, structure, and support, allowing the user to put articles within the pocket 22 without tugging down on the pants or sagging of the pocket 22

The pocket 22 includes a pocket portion 23 and an opening portion 24. The pocket 22 further includes an upper support portion 26. The pocket 22 is sewed to the leg portion 14 and positioned over the seam 20. The seam 20 provides the additional support required for the pocket 22.

As illustrated, clothing 10 further includes pocket 30 and pocket 40. The pocket 30 includes an opening 32 and a zipper 34. The zipper 34 may be utilized to allow the user to access the interior of the pocket 30. The zipper 34 may further include a zipper pull 36. The pocket 30 is positioned over the two major seams 28*a* and 29*a*. The two major seams 28*a* and 29*a* form a generally V-like shape extending away from the major seam 20. The pocket 30 is positioned over both the major seam 28*a* and the major seam 29*a* allowing the pocket 30 to have extra support and structure gained from the two major seams 28*a* and 29*a*.

The pocket 40 (which may be positioned on the opposite side of the pocket 30, as illustrated) includes an opening 42 and a zipper 46. The pocket 40 is also positioned over the major seams 28*b* and 29*b*. The major seams 28*b* and 29*b* may be essentially identical to the major seams 28*a* and 29*a*. The major seams 28*b* and 29*b* generally extend away from and in a V-like formation from the major seam 20. The major seams 28*b* and 29*b* provide the support required to support the pocket 40 and the contents therein.

Modifications, additions, or omissions may be made to clothing 10 without departing from the scope of the invention. For example, clothing 10 may have any number of added pockets, such as 1 pocket, 2 pockets, 4 pockets, or any other number of pockets. As another example, pockets (such as pocket 22, pocket 30, and pocket 40) may be positioned at any location over one or more seams (such as seam 20, seams 28*a* and 29*a*, and seams 28*b* and 29*b*) of clothing 10.

FIGS. 5-8 illustrate a second example of an item of clothing with one or more pockets added to the clothing by adding one or more pocket frames to the clothing in order to hang (or otherwise couple) pockets from the pocket frames. As illustrated, the item of clothing 110 includes a pair of active-wear pants, such as exercise pants, spandex performance pants, or yoga-type pants. The active-wear pants may be made of a stretch fabric that has a compression quality that enhances the performance of the pockets added to the active-wear pants. Although clothing 110 is illustrated as active-wear pants, clothing 110 may be any other suitable type of clothing, such as any other type of pants, shorts, a skirt, or a dress. Clothing 110 includes a waistband portion 112 (which may be reinforced with a foundation fabric or elastic, such as a power mesh contained within the waistband portion 112) and leg portions 114 (such as first leg portion 114*a* and second leg portion 114*b*). Pockets 122, 130, and 140 may be positioned at similar locations as pockets 22, 30, and 50 discussed above with regard to FIGS. 1-4. The pocket 122 includes a main pocket portion 123 and an upper portion 126. The pocket 122 hangs from (or is otherwise coupled to) a pocket frame 124. The pocket frame 124 is affixed (or otherwise coupled) to the leg portion 114. The pocket frame 124 may be affixed (or otherwise coupled) to the leg portion 114 in any suitable manner. For example, the pocket frame 124 may be affixed (or otherwise coupled) onto the fabric of the leg portion 114, onto a seam (such as seam 20 of FIG. 1) of the leg portion 114, onto both the fabric and a seam of the leg portion 114, or any other portion of leg portion 114. In order to affix (or otherwise couple) the pocket frame 124 to the leg portion 114, the pocket frame 124 may be sewn to a portion of the leg portion 114, glued to a portion of the leg portion 114, attached by fasteners to a portion of the leg portion 114, any other means of affixing (or coupling), or any combination of the preceding.

The pocket frame 124 may be any suitable support structure material, such as a boning material, plastic, rubber, metal, fabric, polymer, polymer like, plastic like, or other suitable material operable to hold the pocket 122. The pocket frame 124 may also be enclosed within a fabric or pocket material allowing the pocket to hang from the pocket frame 124. The pocket frame 124 provides support that may prevent tugging on the leg portions 114. As illustrated, the pocket frame 124 is generally rectangular and positioned on the upper portion of the pocket structure. In other embodiments, the pocket frame 124 may be the entire pocket structure.

Pocket 130 includes a pocket frame 134. The pocket frame 134 may extend around a peripheral edge of the pocket 130. Alternatively, the pocket frame 134 of the pocket 130 may be positioned only at a top portion of the pocket, such as shown in pocket 122.

Pocket 140 includes a pocket frame 144 and a zipper/opening 146. The pocket frame 144 of the pocket 140 may be positioned only at the top of the pocket 140. Alternatively, the pocket frame 144 of the pocket 140 may also extend the outer peripheral edge of the pocket 140, or may only extend across a portion of the pocket 140. The pocket frame 144 may also provide structure to prevent tugging of the leg portion 114.

Modifications, additions, or omissions may be made to clothing 110 without departing from the scope of the invention. For example, clothing 110 may have any number of added pockets, such as 1 pocket, 2 pockets, 4 pockets, or any other number of pockets. As another example, pockets (such as pocket 122, pocket 130, and pocket 140) may be positioned at any other location on clothing 110.

FIGS. 9-13 illustrate a third example of an item of clothing with one or more pockets added to the clothing by coupling a cabling system to the clothing, and also coupling one or more pocket frames to the cabling system in order to hang (or otherwise couple) pockets from the pocket frames. As illustrated, the item of clothing 210 includes a pair of active-wear pants, such as exercise pants, spandex performance pants, or yoga-type pants. The active-wear pants may be made of a stretch fabric that has a compression quality that enhances the performance of the pockets added to the active-wear pants. Although clothing 210 is illustrated as active-wear pants, clothing 210 may be any other suitable type of clothing, such as any other type of pants, shorts, a skirt, or a dress. Clothing 210 includes a waistband portion 212 and leg portions 214 (such as first leg portion 214*a* and second leg portion 214*b*).

Waistband portion 212 may be reinforced with a foundation fabric or elastic, such as a power mesh contained within the waistband portion 212. Furthermore, waistband portion 212 may have one or more waistband seams 216 configured to connect the waistband portion 212 to the leg portions 214. As illustrated, waistband portion 212 has a single waistband seam 216. However, waistband portion 212 may have any other number of waistband seams 216, such as 2 waistband seams 216 or more than 2 waistband seams 216. The waistband seam 216 may be arranged around all or a portion of the waistband portion 212. For example, as illustrated, the waistband seam 216 is arranged around all of the waistband portion 212. The waistband seam 216 may be sewed together by means of thread or other suitable fastening material.

Leg portions 214 may each have one or more leg seams 220. For example, first leg portion 214*a* may have first leg seam 220*a* and second leg seam 220*b*, and second leg portion 214*b* may have third leg seam 220*c* and fourth leg seam 220*d*. As another example, first leg portions 214 may each have a single leg seam 220 or more than two leg seams 220. The leg seams 220 may be arranged along at least a portion of the length of the leg portion 214. For example, the leg seams 220 may be arranged along the entire length of the leg portion 214, as illustrated. The legs seams 220 may be sewed together by means of thread or other suitable fastening material.

Clothing 210 further includes an interconnecting cabling system 250. The interconnecting cabling system 250 includes a set of cables coupled to clothing 210 and further coupled to each other. The interconnecting cabling system 250 is configured to provide support for pocket frames 224 and pockets 222, thereby preventing items in the pockets from tugging down clothing 210. Interconnecting cabling system 250 may include one or more waistband cables 254 and one or more leg cables 258.

Waistband cable 254 is coupled to a portion of waistband seam 216 and is configured to provide support for leg cables 258 (which provide support for pocket frames 224 and pockets 222). In particular embodiments, waistband cable 254 may be the main support cable for leg cables 258, pocket frames 224, and pockets 222. Waistband cable 254 may be coupled to all of waistband seam 216, or only a portion of waistband seam 216. For example, as illustrated, waistband cable 254 is coupled to all of waistband seam 216, causing waistband cable 254 to be arranged around all of the waistband portion 212 as one continuous band that may stretch (or that may not stretch). As another example, the waistband cable 254 may only be coupled to a portion of waistband seem 216. In such an example, the waistband cable 254 may have two end portions that may not be coupled to the waistband seem 216. The two end portions may be secured together by, for example, a knot, a glue dot, a silicone dot, a bonded reinforcement, any other means of securing, or any combination of the preceding. This may allow the waistband cable 254 to be tightened (or loosened) when desired by the user. Furthermore, it may further allow the two end portions to remain unsecured from each other for a period of time, such as, for example, when the user is not carrying anything in pockets 222 (or when pockets 222 are not even attached to clothing 210). Additionally, when the user adds content to the pockets 222 (or adds the pockets 222 to the clothing 210), the user may once secure the two ends of the waistband cable 254 together.

Waistband cable 254 may be any suitable cable for providing support for leg cables 258. For example, waistband cable 254 may be any stretchable and supportive band, such as an elastic cord, a stretch cord, webbing, a braid, a band, a ring of neoprene, rubber, silicone tubing, and/or polypropylene, a cable (such as an "all-in-one" cable produced by 3-D printing as, for example, a continuous loop corresponding to the size of clothing 210), any other stretchable and supportive band, or any combination of the preceding. Furthermore, waistband cable 254 may further include a casing (or channel) that includes the stretchable and supportive band inside the casing.

Waistband cable 254 is coupled to the waistband seam 216 in any suitable manner. For example, waistband cable 254 may be sewn onto waistband seam 216. In such an example, a casing (or channel) that includes the stretchable and supportive band may be stitched to the waistband seam 216, or sewn on to the waistband seam 216 with a stitch that allows the waistband cable 254 to move independent of the waistband portion 212 (or otherwise be independent of the waistband portion 212). The stitch may be a zig-zag, a binding, or any other stitch that does not puncture the stretchable and supportive band inside of the casing. Furthermore, the waistband cable 254 (without a casing or channel) may be sewn directly on to the waistband seam 216 with a stitch that encases the waistband cable 254, but does not puncture the waistband cable 254. As another example, the waistband cable 254 may be threaded through (or otherwise attached to) one or more eyelets on the waistband seam 216, one or more spiral bindings on the waistband seam 216, one or more loops on the waistband seam 216, one or more fasteners on the waistband seam 216, any other type of attachment mechanism, or any combination of the preceding. As a further example, the casing (or channel) of waistband cable 254 may be bonded (such as heat bonding), glued, fused, cemented, and/or sealed to the waistband seam 216. In particular embodiments, the waistband cable 254 is coupled to the waistband seam 216 (and/or the waistband portion 212) in a manner that allows the waistband cable 254 to maintain its suspension integrity. As such, the waistband cable 254 may have buoyancy independent of the waistband portion 212, which may allow the waistband cable 254 to support the weight of pockets 222 (and any items in pockets 222), as opposed to the weight being directly supported by the fabric of clothing 210 or directly supported by the waistband portion 212.

Leg cables 258 are coupled to a portion of leg seams 220 and configured to provide support for pocket frames 224 and pockets 222. For example, first leg cable 258*a* and second leg cable 258*b* may be coupled to first leg seam 220*a* and second leg seam 220*b*, respectively. Furthermore, second leg cable 258*c* and fourth leg cable 258*d* may be coupled to third leg seam 220*c* and fourth leg seam 220*d*, respectively. Each leg cable 258 may be coupled to all of the length of a respective leg seam 220, or only a portion of the length of the respective leg seam 220. For example, in order to add pockets to any portion of a leg portion 214*a*, a leg cable 258 may be coupled to the entire length of the respective leg seam 220. As another example, in order to add pockets only above the knee portion of a leg portion 214*a*, a leg cable 258 may be coupled to a length of the respective leg seam 220 that is above (or at) the knee portion of the leg portion 214*a*. In such an example, clothing 210 may not have any portion of the interconnecting cabling system 250 below the knee portion.

Leg cables 258 may be any suitable cables for providing support for pocket frames 224 and pockets 222. For example, leg cables 258 may be any stretchable and supportive band, such as an elastic cord, a stretch cord of neoprene, rubber, silicone tubing, and/or polypropylene, a cable, any other stretchable and supportive band, or any combination of the preceding. As another example, leg cables 258 may be a flexible zipper tape that may allow pocket frames 224 to be slid and locked into place on the leg cables 258. Furthermore, leg cables 258 may further include a casing (or channel) that includes the stretchable and supportive band inside the casing. Leg cables 258 are coupled to the leg seams 220 in any suitable manner. For example, leg cables 258 may be sewn onto leg seams 220. In such an example, a casing (or channel) that includes the stretchable and supportive band may be stitched to the leg seam 220. The stitch may be a zig-zag, a binding, or any other stitch that does not puncture the stretchable and supportive band inside of the casing. Furthermore, the leg cable 258 (without a casing or channel) may be sewn directly on to the leg seam 220 with a stitch that encases the leg cable 258, but does not puncture the leg cable 258. As a further example, the casing (or channel) of waistband cable 254 may be bonded (such as heat bonding), glued, fused, cemented, and/or sealed to the leg seam 220.

Furthermore, the leg cables 258 may be coupled to the waistband cable 254. The leg cables 258 may be coupled to the waistband cable 254 in any suitable manner. For example, the leg cables 258 may be sewn onto (or near) a portion of waistband cable 254 at a location where a leg cable 258 crosses the waistband cable 254 (i.e., the cross-seam). Furthermore, the crossing point may be re-enforced by sewing, stitched embroidery, or a bonded shape (such as a ribbon, a butterfly, a heart, an animal shape, or any other bonded shape). In particular embodiments, the stitch may interloop itself onto the surface of leg seam 220, as is shown by interloop 262 of FIG. 13. This may prevent the stitch from putting holes all the way through leg cable 258 and waistband cable 254. As another example, the leg cables 258 may loop around the waistband cable 254, or be connected to the waistband cable 254 by fasteners.

The pocket frame 224 is coupled to one or more leg cables 258 and is configured to support a pocket 222 hanging from (or otherwise coupled to) the pocket frame 224. For example, as illustrated, first pocket frame 224*a* (from which first pocket 222*a* hangs or is otherwise coupled) is coupled to first and second leg cables 258*a* and 258*b*, and second pocket frame 224*b* (from which second pocket 222*b* hangs or is otherwise coupled) is coupled to third and fourth leg cables 258*c* and 258*d*. The pocket frame 224 may be coupled to any portion of leg cables 258. For example, if the pocket frame 224 (and the respective pocket 222) is located near the waistline portion 212 of clothing 210 (as is illustrated in FIGS. 9-12), the pocket frame 224 may be coupled to the leg cables 258 at a position near the waistline portion 212. As another example, if the pocket frame 224 (and the respective pocket 222) is located near (or just above or below) the knee portion of clothing 210 (as is illustrated in FIGS. 1-4), the pocket frame 224 may be coupled to the leg cables 258 at a position near (or just above or below) the knee portion.

The pocket frame 224 may be coupled to leg cables 258 in any suitable manner. For example, the pocket frame 224 may be sewn onto leg cables 258. In such an example, the pocket frame 224 may be sewn into a casing or channel (discussed above) of the leg cables 258. As another example, the pocket frame 224 may be attached to the leg cables 258 by a zippering mechanism and/or a slide and lock mechanism. In such an example, the leg cables 258 may be (or include) flexible zipper tape and the pocket frame 224 may be (or include) a rigid zipper that rides on top (or in-between) the leg cables 258. Furthermore, the pocket frame 224 and the leg cables 258 can connect with a locking or semi-locking slider, and a piece of power mesh or webbing can be bonded to the zipper tape of the leg cable 258, and ironed onto the leg portions 214 to add stability. As other examples, the pocket frame 224 may be glued to the leg cables 258, attached by fasteners to the leg cables 258, attached to the leg cables 258 by any other means of affixing (or coupling), or any combination of the preceding. In particular embodiments, the pocket frame 224 may be made of boning that runs through its own lightweight casing or channel. In such embodiments, this pocket frame 224 (the boning and channel together) may be bonded (or otherwise coupled) to the back of the pocket 222, and the pocket frame 224 (and the pocket 222) may then be secured onto the leg cables 258 by bonding (or any of the coupling means discussed above).

According to the illustrated embodiment, a first edge of the pocket frame 224*a* is sewn (or otherwise coupled) onto first leg cable 258*a* and a second edge of the pocket frame 224*a* is sewn (or otherwise coupled) onto second leg cable 258*b*. Additionally, the pocket frame 224 may also be coupled to leg portions 214. For example, the back-side of the pocket frame 224 may be glued (or bonded) to the fabric of the leg portions 214, the pocket frame 224 may be attached by fasteners to the fabric of the leg portions 214, the pocket frame 224 may be attached to the fabric of the leg portions 214 by any other means of affixing (or coupling), or any combination of the preceding. In particular embodiments, coupling the pocket frame 224 to leg portions 214 may provide additional stability to pocket 222. However, in such embodiments, the weight of pockets 222 (or a majority of the weight) may be borne by leg cables 258 and waistband cable 254, not leg portions 214.

Figure 11:
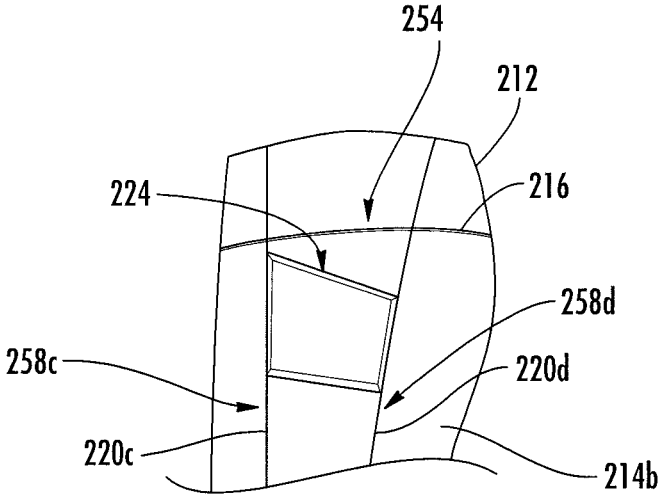
FIG. 11 illustrates a first side partial view of the clothing of FIG. 9 without a pocket.
Figure 12:
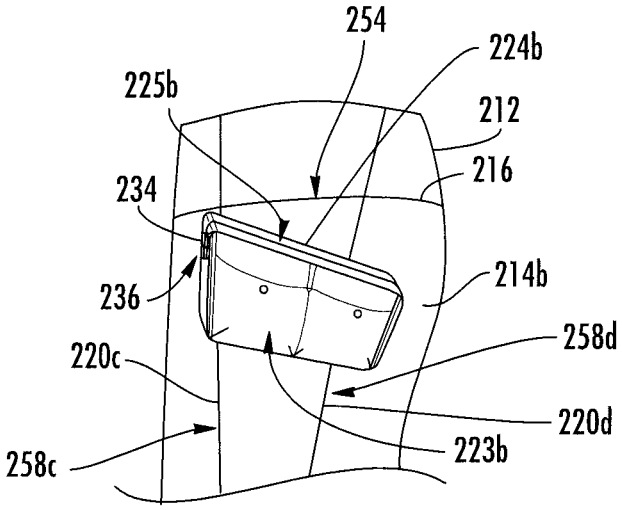
FIG. 12 illustrates a first side partial view of the clothing of FIG. 9 with a pocket.
Figure 13:
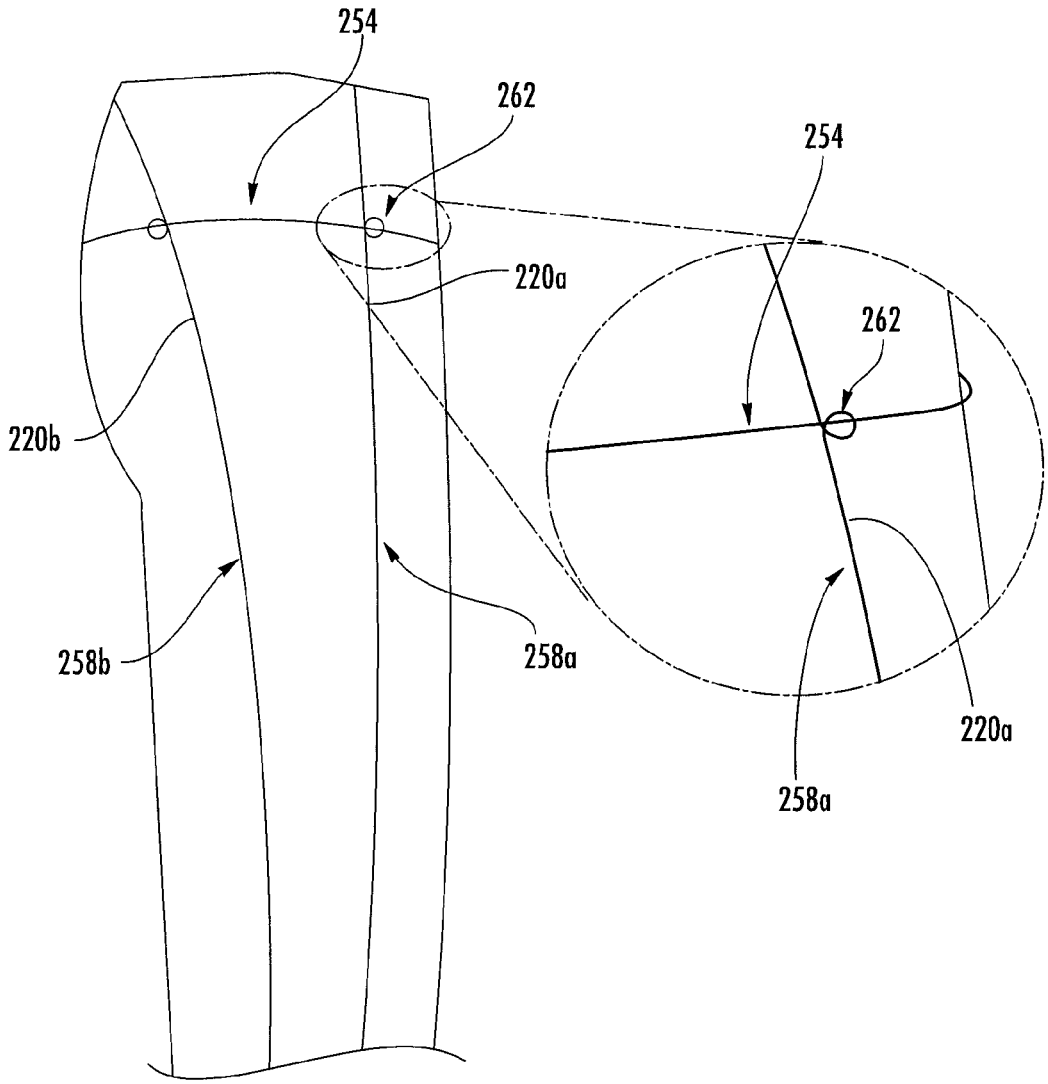
FIG. 13 illustrates a second side partial view of the clothing of FIG. 9 without a pocket.

The pocket frame 224 may be any suitable structure for providing support for the pockets 222. For example, the pocket frame 224 may be a boning material. As another example, the pocket frame 224 may be plastic, rubber, metal, fabric, polymer, polymer like, plastic like, or other suitable material for providing support for the pockets 222. Furthermore the pocket frame 224 may include both a frame casing and a support structure coupled inside of the frame casing. In such an example, the support structure may be, for example, a boning material (or any of the other materials discussed above with regard to the pocket frame 224), and the frame casing may be a fabric that encases the boning material. The pocket frame 224 may have any suitable shape for providing support for the pockets 222. For example, the pocket frame 224 may be rectangular, circular, oval, square, polygonal, irregular shaped, or any other suitable shape. As another example, the pocket frame 224 may be generally rectangular (or circular, oval, or square). As a further example, the shape of the pocket frame 224 may be an entirely solid piece of, for example, boning material, or the shape of the pocket frame 224 may include a hole in the middle (e.g., with the boning material surrounding the hole). In particular embodiments, the pocket frame 224 may be shaped to fit in-between two leg cables 258, as is illustrated in FIG. 11. In particular embodiments, instead of fitting in-between two leg cables 258, the pocket frame 224 may be placed on top of leg cables 258. For example, when leg cables 258 are a flexible zipper tape, the pocket frame 224 may be slid and locked on top of leg cables 258.

The pocket 222 is coupled to a pocket frame 224 and is configured to hold one or more items. For example, as illustrated, first pocket 222*a* is coupled to first pocket frame 224*a*, and second pocket 222*b* is coupled to second pocket frame 224*b*. A pocket 222 may be coupled to any pocket frame 224 coupled to any portion of leg cables 258 (as is discussed above with regard to the pocket frames 224). The pocket 222 may be coupled to a pocket frame 224 in any suitable manner. For example, the pocket 222 may be sewn onto the pocket frame 224. In such an example, the pocket 222 may be sewn into a frame casing (discussed above) of the pocket frame 224. As other examples, the pocket 222 may be glued to the pocket frame 224, attached by fasteners to the pocket frame 224, attached to the pocket frame 224 by any other means of affixing (or coupling), or any combination of the preceding. The coupling of the pocket 222 to the pocket frame 224 may cause the pocket 222 to hang from the pocket frame 224. Additionally, the pocket 222 may also be coupled to leg portions 214. For example, a back-side of the pocket 222 may be attached to the fabric of the leg portions 214, the back-side of the pocket 222 may be glued to the fabric of the leg portions 214, the pocket 222 may be bonded to the fabric of the leg portions 214, the pocket 222 may be fused to the fabric of the leg portions 214, the pocket 222 may be attached to the fabric of the leg portions 214 by any other means of affixing, or any combination of the preceding. In particular embodiments, coupling the pocket 222 to leg portions 214 may provide additional stability to pocket 222. However, in such embodiments, the weight of pockets 222 (or a majority of the weight) may be borne by leg cables 258 and waistband cable 254, not leg portions 214.

The pocket 222 may have any suitable shape for holding one or more items. For example, the pocket 222 may be rectangular, circular, oval, square, polygonal, irregular shaped, or any other suitable shape. As another example, the pocket 222 may be generally rectangular (or circular, oval, or square). The pocket 222 may have the same shape as the pocket frame 224 to which the pocket 222 is coupled. Alternatively, the pocket 222 may have a different shape than the pocket frame 224 to which the pocket 222 is coupled. In particular embodiments, pockets 222 may be customized and molded to hold specific tools for trade and task, or for specific applications. The pocket 222 may have any suitable size. For example, the pocket 222 may be extra-large, large, medium, small, any other size, or any combination of the preceding. The pocket 222 may be a single pocket, or it may have two or more sub-pockets. For example, as illustrated, the pocket 222 may have two sub-pockets that may individually hold separate items. In such an example, each sub-pocket may be opened separately, or at the same time. The pocket 222 may be made of any suitable material for holding one or more items. For example, the pocket 222 may be made of a thin and strong fabric, such as ripstop nylon and/or Gore-Tex. As another example, the pocket 222 may be made of any other type of fabric or molded material.

As illustrated, the pocket 222 includes a pocket portion 223 and an opening portion 225. Furthermore, the pocket 222 may include any suitable mechanism for opening and closing the opening portion 225 of the pocket 222. For example, as illustrated, the pocket 222 may include a zipper 234 and zipper pull 236 for opening and closing the opening portion 225. As further examples, the pocket 222 may include one or more pocket snaps, one or more buttons, one or more tie cords, any other mechanism for opening and closing the opening portion 225, or any combination of the preceding. As another example, the pocket 222 may not include any mechanism for closing the opening portion 225. In such an example, the opening portion 225 may always be open for inserting or removing one or more items.

The pockets 222 may be added to clothing 210 according to any suitable method. As an example, one method for adding pockets 222 to clothing 210 is discussed below.

First, one or more waistband cables 254 may be coupled to a portion of one or more waistband seams 216 of clothing 210. A waistband cable 254 may be coupled to all of a waistband seam 216, or only a portion of a waistband seam 216. Furthermore, the waistband cable 254 may be coupled to the waistband seam 216 in any suitable manner. For example, the waistband cable 254 may be sewn onto the waistband seam 216. As another example, the waistband cable 254 may be coupled to the waistband seam 216 using any of the other couplings discussed above with regard to waistband cable 254.

Second, one or more leg cables 258 may be coupled to a portion of one or more leg seams 220. A leg cable 258 may be coupled to all of a leg seam 220, or only a portion of the leg seam 220. Furthermore, the leg cable 258 may be coupled to a leg seam 220 in any suitable manner. For example, the leg cable 258 may be sewn onto a leg seam 220. As another example, the leg cable 258 may be coupled to the leg seam 220 using any of the other couplings discussed above with regard to leg cable 258.

Third, one or more leg cables 258 may be coupled to the one or more waistband cables 254. A leg cable 258 may be coupled to a waistband cable 254 in any suitable manner. For example, a leg cable 258 may be sewn onto (or near) a portion of the waistband cable 254 at a location where the leg cable 258 crosses the waistband cable 254 (i.e., the cross-seam). Furthermore, the crossing point may be re-enforced by sewing, stitched embroidery, or a bonded shape (such as a ribbon, a butterfly, a heart, an animal shape, or any other bonded shape). As another example, the leg cable 258 may be coupled to the waistband cable 254 using any of the other couplings discussed above with regard to leg cable 258.

Fourth, one or more pocket frames 224 may be coupled to one or more leg cables 258. A pocket frame 224 may be coupled to any number of leg cables 258, such as one leg cable 258, two leg cables 258, three leg cables 258, or any other number of leg cables 258. Furthermore, a pocket frame 224 may be coupled to any portion of one or more leg cables 258. Additionally, the pocket frame 224 may be coupled to one or more leg cables 258 in any suitable manner. For example, the pocket frame 224 may be sewn onto the leg cables 258. As another example, the pocket frame 224 may be coupled to the leg cables 258 using any of the other couplings discussed above with regard to pocket frame 224.

Fifth, one or more pockets 222 may be coupled to one or more pocket frames 224. A pocket 222 may be coupled to a pocket frame 224 in any suitable manner. For example, the pocket 222 may be sewn onto the pocket frame 224. As another example, the pocket 222 may be coupled to the pocket frame 224 using any of the other couplings discussed above with regard to pocket 222.

Sixth, the method may end. Modifications, additions, or omissions may be made to the disclosed method. For example, the method may further include coupling the pocket frame 224 to one or more leg portions 214 and/or coupling the pocket 222 to one or more leg portions 214. Additionally, the steps may be performed in parallel or in any suitable order.

Modifications, additions, or omissions may be made to clothing 210 without departing from the scope of the invention. For example, clothing 210 may have any number of added pockets, such as 1 pocket, 2 pockets, 3 pockets, 4 pockets, or any other number of pockets. In an example where clothing 210 includes 3 pockets, a first pocket 222*a* may be coupled to a first pocket frame 224*a* (which may be coupled to first and second leg cables 258*a* and 258*b*), a second pocket 222*b* may be coupled to a second pocket frame 224*b* (which may be coupled to third and fourth leg cables 258*c* and 258*d*), and a third pocket 222 (not shown) may be coupled to a third pocket frame 224 (not shown and which may be coupled to either first and second leg cables 258*a* and 258*b* or third and fourth leg cables 258*c* and 258*d*). As another example, pockets (such as pocket 222*a* and pocket 222*b*) may be positioned at any other location on clothing 210. In such an example, a first pocket 222*a* may be coupled to a first pocket frame 224*a* (which may be coupled to first and second leg cables 258*a* and

258*b*), and a second pocket 222*b* may be coupled to a second pocket frame 224*b* (which may also be coupled to first and second leg cables 258*a* and 258*b*).

Furthermore, although the pocket frame 224 (and the pocket 222 coupled to the pocket frame 224) is described above as being fixedly coupled to leg cables 258 (e.g., by sewing, by gluing, etc.), in particular embodiments, the pocket frame 224 (and the pocket 222 coupled to the pocket frame 224) may be movably coupled to the leg cables 258. For example, once the pocket frame 224 is coupled to the leg cables 258, the pocket frame 224 (and the pocket 222 coupled to the pocket frame 224) may be slid (or otherwise moved) along the leg cables 258. In particular embodiments, this may allow a user to slide (or otherwise move) the pocket 222 to any position on a leg portion 214. For example, the user may position the pocket 222 near waistline 212 for a first part of the day (or any other amount of time), and then the user may re-position the pocket 222 near the knee portion (or any other portion, such as the ankle portion) of clothing 210 for a second part of the day (or any other amount of time). Furthermore, the pocket frames 224 and/or the leg cables 258 may include a locking mechanism that will hold the pocket frame 224 (and the pocket 222) in a particular position while the locking mechanism is locked, but will allow the pocket frame 224 (and the pocket 222) to slide (or otherwise move) when the locking mechanism is not locked. The movable coupling of the pocket frame 224 to the leg cables 258 may include any suitable movable coupling, such as a track and lockable slider configuration, a railing and lockable wheel configuration, or any other type of coupling that allows the pocket frame 224 to slide (or otherwise move) along leg cables 258.

Furthermore, in particular embodiments, the pocket frame 224 (and the pocket 222 coupled to the pocket frame 224) may be detachably coupled to the leg cables 258. For example, once the pocket frame 224 is coupled to the leg cables 258, the pocket frame 224 (and the pocket 222 coupled to the pocket frame 224) may be removed from the leg cables 258 (or removed and re-coupled to a different position on the leg cables 258 or to different leg cables 258). In particular embodiments, this may allow a user to move the pocket 222 to any position on a leg portion 214 (or to move the pocket 222 to any position on a different leg portion 214). For example, the user may position the pocket 222 near waistline 212 for a first part of the day (or any other amount of time), and then the user may re-position the pocket 222 near the knee portion (or any other portion, such as the ankle portion) of clothing 210 for a second part of the day (or any other amount of time). In particular embodiments, this may also allow a user to remove the pocket 222 from clothing 210 for a particular amount of time. For example, the user may remove the pocket 222 entirely from clothing 210 for a first part of the day (or any other amount of time), and then the user may couple the pocket 222 near waistline 212 (or any other portion of clothing 210) for a second part of the day (or any other amount of time). The detachable coupling of the pocket frame 224 to the leg cables 258 may include any suitable detachable coupling that allows the pocket frame 224 to be detached and moved to other portions of leg cables 245 (or removed entirely from leg cables 258). For example, the leg cables 258 may include one or more fasteners (such as buttons, zippers, or velcro) positioned at different locations on leg cables 258. In such an example, the pocket frames 224 may be coupled in and out of the fasteners in order to move (or remove) the pocket frames 224.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth in this specification. Such embodiments may be obtained, for example, by combining, modifying, or reorganizing any of the disclosed steps, components, elements, features, aspects, characteristics, limitations, and the like, of the various non-limiting and non-exhaustive embodiments described in this specification. In this manner, Applicant reserves the right to amend the claims during prosecution to add features as variously described in this specification, and such amendments comply with the requirements of 35 U.S.C. §§112(a) and 132(a).

The invention claimed is:

1. A pocket system, comprising:

active-wear pants having a waistband portion, a first leg portion, and a second leg portion, wherein the waistband portion is connected to the first and second leg portions by a waistband seam arranged around the waistband portion, wherein the first leg portion includes first and second leg seams arranged along at least a portion of a length of the first leg portion, wherein the second leg portion includes third and fourth leg seams arranged along at least a portion of a length of the second leg portion;

an interconnecting cabling system coupled to the active-wear pants and comprising:

a waistband cable coupled to a portion of the waistband seam, wherein the coupling allows the waistband cable to move independently of the waistband portion;

first and second leg cables coupled respectively to a portion of the first and second leg seams, the first and second leg cables further coupled to the waistband cable; and third and fourth leg cables coupled respectively to a portion of the third and fourth leg seams, the third and fourth leg cables further coupled to the waistband cable, wherein each of the waistband cable, the first and second leg cables, and the third and fourth leg cables comprise a casing and an elastic draw cord coupled inside the casing;

a first pocket frame coupled to each of the first and second leg cables, the first pocket frame shaped to fit in-between the first and second leg cables, the first pocket frame comprising a first frame casing and a first support structure coupled inside of the first frame casing;

a first pocket coupled to the first pocket frame;

a second pocket frame coupled to each of the third and fourth leg cables, the second pocket frame shaped to fit in-between the third and fourth leg cables, the second pocket frame comprising a second frame casing and a second support structure coupled inside of the second frame casing; and a second pocket coupled to the second pocket frame.

2. A pocket system, comprising:

an item of clothing having a waistband portion, a first leg portion, and a second leg portion, wherein the waistband portion is connected to the first and second leg portions by one or more waistband seams arranged around at least a portion of the waistband portion, wherein the first leg portion includes one or more first leg seams arranged along at least a portion of a length of the first leg portion, wherein the second leg portion includes one or more second leg seams arranged along at least a portion of a length of the second leg portion;

one or more waistband cables coupled to a portion of the one or more waistband seams, wherein the coupling allows the one or more waistband cables to move independently of the waistband portion;

one or more leg cables coupled to a portion of the one or more first leg seams and further coupled to the one or more waistband cables;

a first pocket frame coupled to the one or more leg cables; and a first pocket coupled to the first pocket frame.

3. The pocket system of claim 2, wherein the item of clothing comprises one of the following:

pants;

shorts;

a skirt; and a dress.

4. The pocket system of claim 2, wherein the item of clothing comprises active-wear pants.

5. The pocket system of claim 2, wherein:

the one or more first leg seams comprise two first leg seams; and the one or more leg cables comprise two leg cables.

6. The pocket system of claim 5, wherein:

the first pocket frame is shaped to fit in-between the two leg cables;

the first pocket frame comprises a first edge coupled to a first of the two leg cables; and the first pocket frame comprises a second edge coupled to a second of the two leg cables.

7. The pocket system of claim 2, further comprising:

one or more second leg cables coupled to a portion of the one or more second leg seams and further coupled to the one or more waistband cables;

a second pocket frame coupled to the one or more second leg cables; and a second pocket coupled to the second pocket frame.

8. The pocket system of claim 7, further comprising:

a third pocket frame coupled to:

the one or more leg cables; or the one or more second leg cables; and a third pocket coupled to the third pocket frame.

9. The pocket system of claim 2, further comprising:

a second pocket frame coupled to the one or more leg cables; and a second pocket coupled to the second pocket frame.

10. The pocket system of claim 2, wherein each of the one or more waistband cables and the one or more leg cables comprise a casing and an elastic draw cord coupled inside the casing.

11. The pocket system of claim 2, wherein the first pocket frame is coupled on top of the one or more leg cables by a zipper.

12. The pocket system of claim 2, wherein the first pocket frame is moveably coupled to the one or more leg cables.

13. A method, comprising:

coupling one or more waistband cables to a portion of one or more waistband seams of an item of clothing having a waistband portion, a first leg portion, and a second leg portion, wherein the one or more waistband seams are arranged around at least a portion of the waistband portion and connect the waistband portion to the first and second leg portions, wherein the first leg portion includes one or more first leg seams arranged along at least a portion of a length of the first leg portion, wherein the second leg portion includes one or more second leg seams arranged along at least a portion of a length of the second leg portion, wherein the coupling allows the one or more waistband cables to move independently of the waistband portion;

coupling one or more leg cables to a portion of the one or more first leg seams and further coupling the one or more leg cables to the one or more waistband cables;

coupling a first pocket frame to the one or more leg cables; and coupling a first pocket to the first pocket frame.

14. The method of claim 13, wherein the item of clothing comprises one of the following:

pants;

shorts;

a skirt; and a dress.

15. The method of claim 13, wherein the item of clothing comprises active-wear pants.

16. The method of claim 13, wherein:

the one or more first leg seams comprise two first leg seams; and the one or more leg cables comprise two leg cables.

17. The method of claim 16, wherein:

the first pocket frame is shaped to fit in-between the two leg cables; and coupling the first pocket frame to the one or more leg cables comprises:

coupling a first edge of the first pocket frame to a first of the two leg cables; and coupling a second edge of the first pocket frame to a second of the two leg cables.

18. The method of claim 13, further comprising:

coupling one or more second leg cables to a portion of the one or more second leg seams and further coupling the one or more second leg cables to the one or more waistband cables;

coupling a second pocket frame to the one or more second leg cables; and coupling a second pocket to the second pocket frame.

19. The method of claim 18, further comprising:

coupling a third pocket frame to:

the one or more leg cables; or the one or more second leg cables; and coupling a third pocket to the third pocket frame.

20. The method of claim 13, wherein the first pocket frame comprises a first frame casing and a first support structure coupled inside of the first frame casing.

* * * * *